US005980150A

United States Patent [19]

Newman et al.

[11] Patent Number: 5,980,150

[45] Date of Patent: Nov. 9, 1999

[54] QUARTER TURN TOILET SEAT PIN WITH THREADED LOCK BOLT

[76] Inventors: Richard G. Newman; Thelma D. Newman, both of 38136 Van Born Rd., Wayne, Mich. 48184-1577; Marina Ann Wright, 2429 Treadwell, Westland, Mich. 48186

[21] Appl. No.: 08/990,231

[22] Filed: Dec. 15, 1997

[51] Int. Cl.[6] ..... A47K 13/12

[52] U.S. Cl. ..... 403/349; 403/325; 403/362; 4/236; 4/240; 411/552

[58] Field of Search ..... 4/234–241; 403/348, 403/349, 362, 321, 325; 16/261, 262; 411/551–552, 14

[56] References Cited

U.S. PATENT DOCUMENTS

| | | | |
|---|---|---|---|
| 2,672,924 | 3/1954 | Anthes | 403/325 X |
| 3,561,076 | 2/1971 | Gunther | 411/552 X |
| 5,120,174 | 6/1992 | Patti | 411/14 X |
| 5,222,849 | 6/1993 | Walton | 411/14 |
| 5,227,287 | 7/1993 | Gunther | 411/552 |
| 5,638,554 | 6/1997 | Corzine | 4/236 |
| 5,716,180 | 2/1998 | Bowers | 411/551 |

*Primary Examiner*—Lynne H. Browne
*Assistant Examiner*—John Cottingham

[57] ABSTRACT

A quarter turn toilet seat pin including a bolt with an elongated bolt with a bolt head, an end portion and a body member. The body member has a linear key way extending upwardly from the end portion. The linear key way has a top end with a side-lock key way. The side-lock key way has a slot. Also, a sleeve is provided and engages the bolt. The sleeve has an interior channel sized for receiving the body member of the bolt. The sleeve has an axial opening that is in receipt of a threaded nipple. The threaded nipple projects from the opening and into the interior of the sleeve for engaging the linear key way as the bolt being slid into the sleeve.

1 Claim, 2 Drawing Sheets

QUARTER TURN TOILET SEAT PIN WITH THREADED LOCK BOLT

BACKGROUND OF THE INVENTION

1. Field of the Invention

The present invention relates to a quarter turn toilet seat pin with threaded lock bolt and more particularly pertains to providing easy to remove toilet seat bolt that allows the seat to be easily removed and attached.

2. Description of the Prior Art

The use of a toilet seat bolt is known in the prior art. More specifically, toilet seat bolts heretofore devised and utilized for the purpose of securing a toilet seat to a toilet are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,414,875 to Kappl et al. discloses a quick release seat latch.

U.S. Pat. No. 5,267,357 to Ades discloses a releasable toilet lid and seat locking apparatus.

U.S. Pat. No. 4,367,567 to Sendoykas discloses a detachable hinge assembly.

U.S. Pat. No. 4,319,365 to Bemis and Kelly discloses a no tool toilet seat hardware.

Lastly, U.S. Des. Pat. No. 358,973 to Spaeth discloses a toilet seat hinge.

In this respect, the quarter turn toilet seat pin with threaded lock bolt according to the present invention substantially departs from the conventional concepts and designs of the prior art, and in so doing provides an apparatus primarily developed for the purpose of providing easy to remove toilet seat bolt that allows the seat to be easily removed and attached.

Therefore, it can be appreciated that there exists a continuing need for a new and improved quarter turn toilet seat pin with threaded lock bolt which can be used for providing easy to remove toilet seat bolt that allows the seat to be easily removed and attached. In this regard, the present invention substantially fulfills this need.

SUMMARY OF THE INVENTION

In view of the foregoing disadvantages inherent in the known types of toilet seat bolts now present in the prior art, the present invention provides an improved quarter turn toilet seat pin with threaded lock bolt. As such, the general purpose of the present invention, which will be described subsequently in greater detail, is to provide a new and improved quarter turn toilet seat pin with threaded lock bolt which has all the advantages of the prior art and none of the disadvantages.

To attain this, the present invention essentially comprises a generally elongated bolt. The bolt has a bolt head, an end portion and a generally cylindrical body member. The bolt head has a channel that is defined along the top surface of the bolt head. The body member has length and a linear key way extending upwardly from the end portion. The linear key way has a length about ⅓ the length of the body member. The linear key way has a top end with a side-lock key way that is perpendicularly extended. The side-lock key way has a slot. Included is a generally cylindrical sleeve. The sleeve engages the bolt. The sleeve has an interior channel sized for receiving the body member of the bolt. The sleeve has an axial opening that is in receipt of a threaded nipple. The threaded nipple projects from the opening and into the interior of the sleeve. The threaded nipple engages the linear key way as the bolt is slid into the sleeve. The threaded nipple engages the side-lock key when the bolt is rotated within the sleeve. The threaded nipple locks the bolt therein by resting within the slot after traversing the side-lock key way of the body member.

Finally, a coiled spring is positioned around the body member of the bolt and held thereabout by a washer. The coiled spring is positioned around the body member of the bolt for allowing the bolt member within the sleeve to resiliently move up and down within the sleeve. The up and down movement of the bolt within the sleeve allows movement of the threaded nipple within the slot to cause locking and unlocking of the bolt.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved quarter turn toilet seat pin with threaded lock bolt which has all the advantages of the prior art toilet seat bolts and none of the disadvantages.

It is another object of the present invention to provide a new and improved quarter turn toilet seat pin with threaded lock bolt which may be easily and efficiently manufactured and marketed.

It is a further object of the present invention to provide a new and improved quarter turn toilet seat pin with threaded lock bolt which is of a durable and reliable construction.

An even further object of the present invention is to provide a new and improved quarter turn toilet seat pin with threaded lock bolt which is susceptible of a low cost of manufacture with regard to both materials and labor, and which accordingly is then susceptible of low prices of sale to the consuming public, thereby making such quarter turn toilet seat pin with threaded lock bolt economically available to the buying public.

Still yet another object of the present invention is to provide a new and improved quarter turn toilet seat pin with threaded lock bolt which provides in the apparatuses and methods of the prior art some of the advantages thereof, while simultaneously overcoming some of the disadvantages normally associated therewith.

Still another object of the present invention is to providing easy to remove toilet seat bolt that allows the seat to be easily removed and attached.

Lastly, it is an object of the present invention to provide a new and improved toilet seat pin that has an elongated bolt with a bolt head, an end portion and a body member. The body member has a linear key way extending upwardly from the end portion. The linear key way has a top end with a side-lock key way. The side-lock key way has a slot. Also, a sleeve is provided and engages the bolt. The sleeve has an interior channel sized for receiving the body member of the bolt. The sleeve has an axial opening that is in receipt of a threaded nipple. The threaded nipple projects from the opening and into the interior of the sleeve for engaging the linear key way as the bolt being slid into the sleeve.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
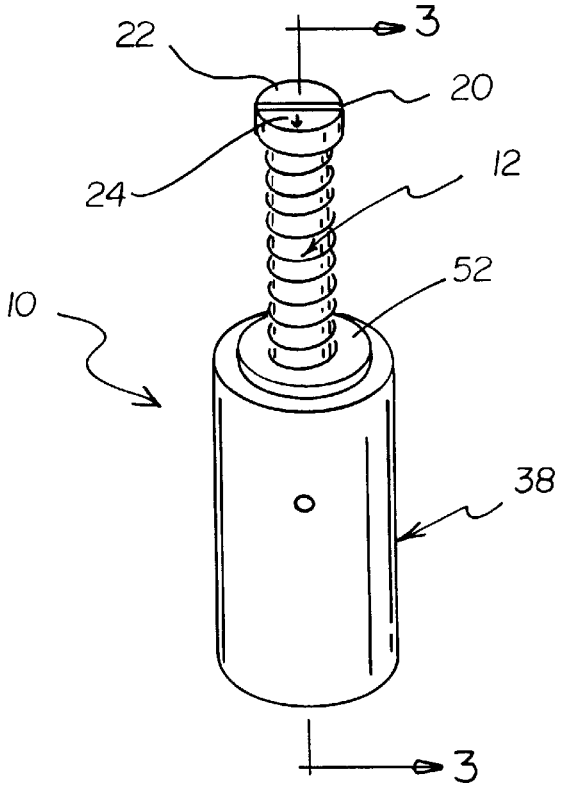
FIG. 1 is a perspective illustration of the preferred embodiment of the quarter turn toilet seat pin with threaded lock bolt constructed in accordance with the principles of the present invention.

With reference now to the drawings, and in particular to FIG. 1 thereof, a new and improved quarter turn toilet seat pin with threaded lock bolt embodying the principles and concepts of the present invention and generally designated by the reference numeral 10 will be described.

The present invention, the new and improved quarter turn toilet seat pin with threaded lock bolt, is comprised of a plurality of components. Such components in their broadest context include a bolt and a sleeve. Such components are individually configured and correlated with respect to each other so as to attain the desired objective.

Figure 3:
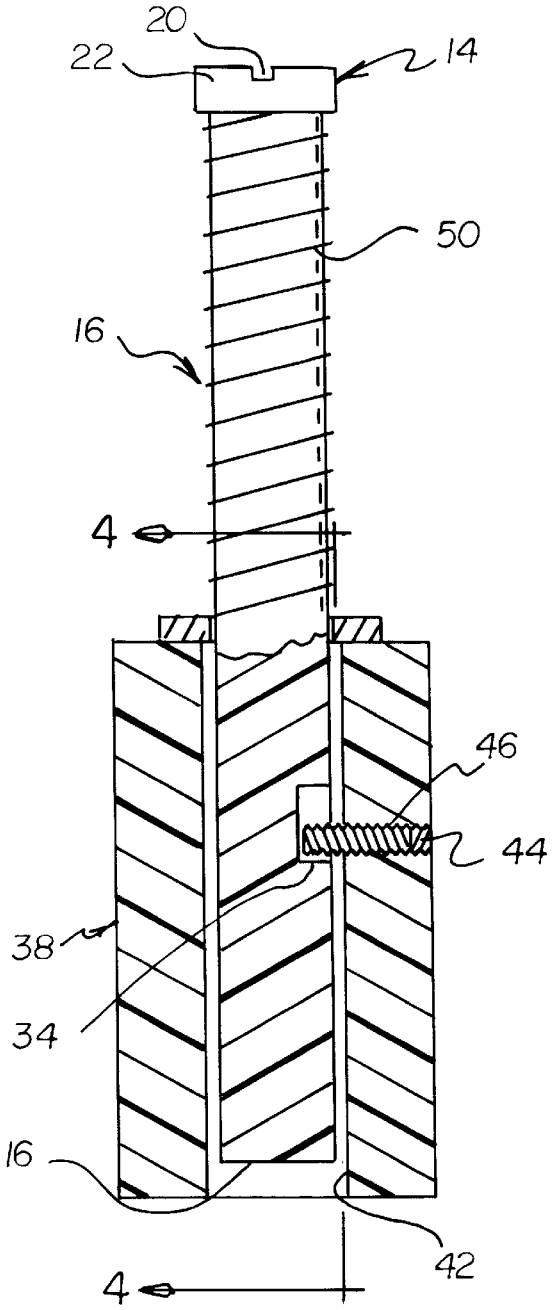
FIG. 3 is a cross-sectional view of the present invention taken along line 3—3 of FIG. 1.

More specifically, the present invention includes a generally elongated bolt 12. The bolt, as seen in FIG. 3, has a bolt head 14, an end portion 16 and a generally cylindrical body member 16. The bolt head, as seen in FIG. 1, has a channel 20 that is defined along the top surface 22 of the bolt head. Spaced from the channel is an arrow indicia 24.

Figure 4:
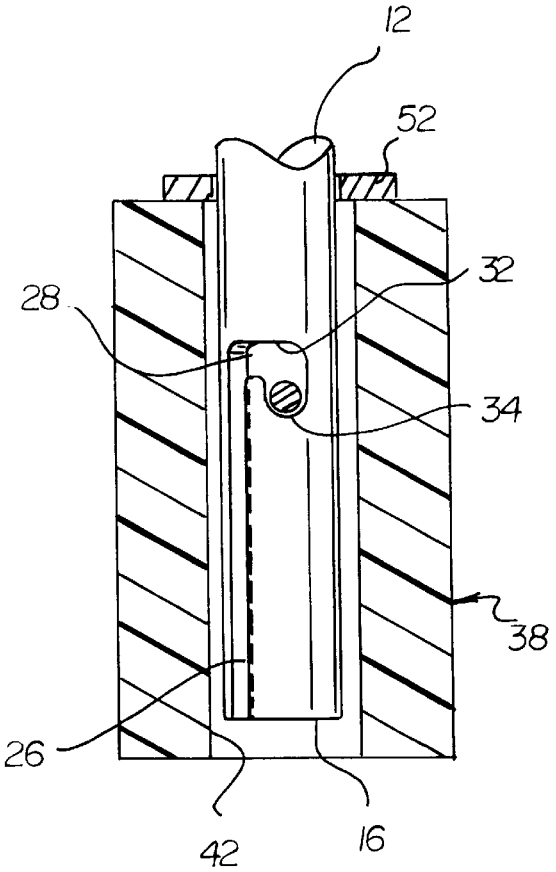
FIG. 4 is a cross sectional view of the sleeve of the present invention taken along line 4—4 of FIG. 3.

Also, the body member has length of about 5 inches and a diameter of about ½ inch. The body member has a linear key way 26 recessed therein. As shown in FIG. 4, the linear key way extends upwardly from the end portion 16. The linear key way has a length about ⅓ the length of the body member and a depth of about ¼ inch. The linear key way has a top end 28 with a side-lock key way 32. The side-lock key way is perpendicularly extended from the top end of the linear key way. The side-lock key way has a slot 34. The slot slightly parallel the linear key way and extends downward from the side-lock key way.

Figure 2:
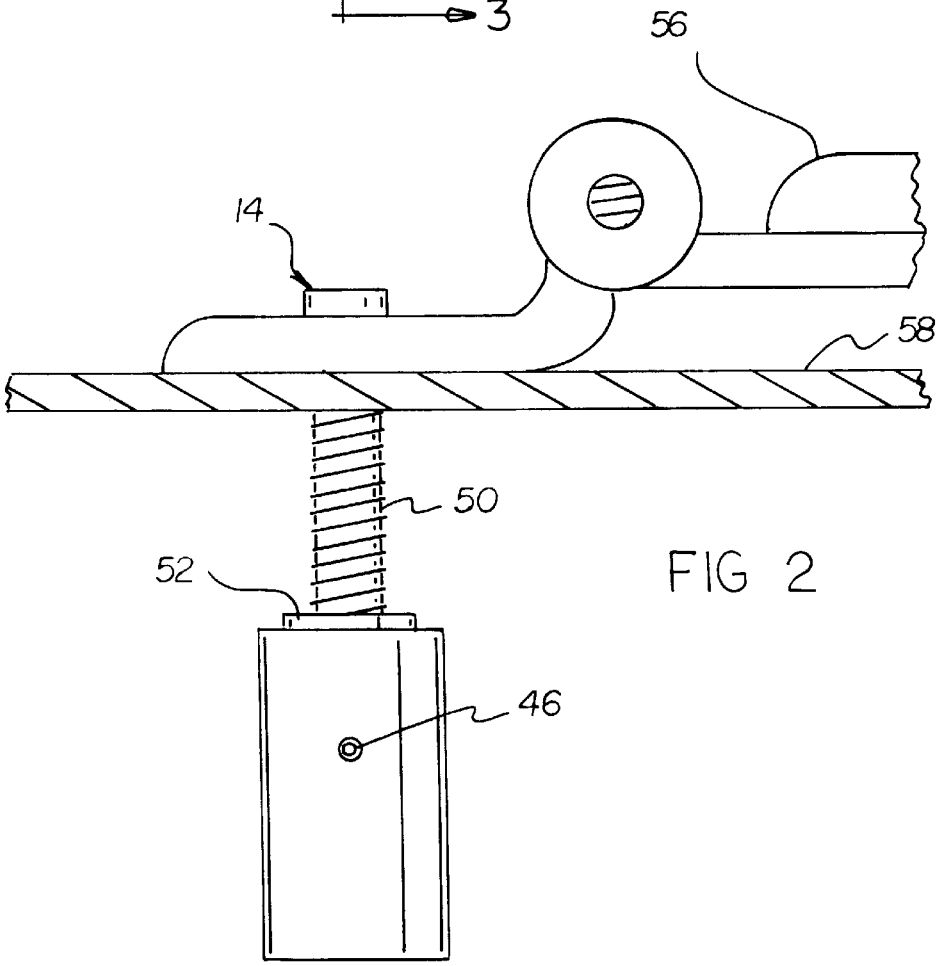
FIG. 2 is a perspective illustration of the preferred embodiment in an operable orientation.

Included is a generally cylindrical sleeve 38 as best illustrated in FIG. 2. The sleeve, as shown in FIG. 1, engages the bolt 12. The sleeve has an interior channel 42 that is sized for receiving the body member of the bolt. The sleeve has an axial opening 44 that is in receipt of a threaded nipple 46. The threaded nipple projects from the opening and into the interior of the sleeve, as seen in FIG. 3. The threaded nipple is adjustable within the opening. The treaded nipple may be rotated further into the interior channel or rotated completely out of the interior channel.

Additionally, the threaded nipple, as depicted in FIG. 3, engages the linear key way as the bolt is slid into the sleeve. The threaded nipple engages the side-lock key when the bolt is rotated within the sleeve. The threaded nipple locks the bolt therein by resting within the slot after traversing the side-lock key way of the body member 16. If need be the threaded nipple can be rotated away from the slot so as to release the bolt from the channel.

Finally, a coiled spring 50 is positioned around the body member 16 of the bolt. The spring is held around the bolt by a washer 52. The coiled spring is positioned around the body member of the bolt to allow the bolt member, within the sleeve, to resiliently move up and down within the sleeve. The up and down movement of the bolt within the sleeve allows movement of the threaded nipple within the slot to cause locking and unlocking of the bolt. In operation the user would place the bolt through the toilet seat 56 and the toilet 58. The bolt sleeve is then slid onto the bolt. The nipple is extended so as to engage the linear key way. Once the nipple reaches the top end of the linear key way the sleeve is turned and the nipple engages the side-lock key way and the slot. To release the sleeve the user can take a screw driver and turn the bolt head while holding the sleeve.

Furthermore, the bolt and sleeve are made of a rigid plastic. The arrow on the bolt head points in the direction of the linear key way. This will help the user determine were the linear key way is with out trying to look under the sleeve.

The present invention quarter turn toilet seat pin with threaded lock bolt provides for an easy-off, easy-on toilet seat attachment. As can be seen readily seen with particular reference to FIG. 2, the upper extent of the bolt extends through the aperture of the toilet seat as well as the aperture of the toilet. The lower surface of the bolt head is in contact with the upper surface of the toilet seat while the upper surface of the spring is in contact with the lower surface of the toilet. This urges the toilet and the toilet seat in mating contact with each other and effects the mutual and releasable coupling therebetween. The invention is comprised of a five inch long ½ inch wide bolt with a ¼ inch linear key way and a ¼ inch horizontal key way with a slot. A spring and washer are place on the bolt. The bolt then fits into a 3 inch long sleeve that fits underneath the commode. The present invention replaces the standard toilet seat bolt. To release the bolt from the sleeve, simply push up on the sleeve and give it a quarter-turn. The nipple slides through the two key ways and the two components will come apart, thus allowing the bolt to be lifted out and the toilet seat removed.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An easy clean toilet seat pin for securing a toilet seat with an aperture to a toilet with an aperture comprising, in combination:

a generally elongated bolt having a bolt head, an end portion and a generally cylindrical body member therebetween, the bolt head having a channel being defined along a top surface thereof and an arrow spaced from the channel and extending perpendicularly therefrom for indicating the location of the linear key way, the body member having length and an elongated linear key way extending upwardly form the end portion, the linear key way having a length about ⅓ the length of the body member, the linear key way having a top end with a side-lock key way perpendicularly extending therefrom, the side-lock key having a slot;

a generally cylindrical sleeve for engaging the bolt, the sleeve having an interior channel sized for receiving the body member of the bolt, the sleeve having an axial opening being in receipt of a threaded nipple, the threaded nipple projecting from the opening and into the interior of the sleeve for engaging the linear key way as the bolt being slid into the sleeve, the threaded nipple engages the side-lock key when the bolt being rotated within the sleeve, the threaded nipple locking the bolt therein by resting within the slot after traversing the side-lock key way of the body member; and a coiled spring being positioned around the body member of the bolt and held thereabout by a washer, the coiled spring being positioned around the body member of the bolt for allowing the bolt member within the sleeve to resiliently move up and down within the sleeve and allowing movement of the threaded nipple within the slot to cause locking and unlocking of the bolt, the upper extent of the bolt extending through the aperture of the toilet seat and the aperture of the toilet with the bolt head in contact with the toilet seat and the spring in contact with the toilet for the coupling therebetween.

* * * * *